US006868585B2

(12) United States Patent
Anthony et al.

(10) Patent No.: US 6,868,585 B2
(45) Date of Patent: Mar. 22, 2005

(54) WEB ADJUSTER DEVICE

(75) Inventors: James R. Anthony, Carmel, IN (US); Guy R. Dingman, Westfield, IN (US); Nick A. Campbell, Anderson, IN (US); Michael A. Wiseman, Avon, IN (US); Gregory L. Woodard, Brownsburgh, IN (US); Steven T. Berenyl, Indianapolis, IN (US)

(73) Assignee: Indiana Mills & Manufacturing, Inc., Westfield, IN (US)

( * ) Notice: Subject to any disclaimer, the term of this patent is extended or adjusted under 35 U.S.C. 154(b) by 0 days.

(21) Appl. No.: 10/205,258

(22) Filed: Jul. 25, 2002

(65) Prior Publication Data

US 2003/0019080 A1 Jan. 30, 2003

Related U.S. Application Data

(60) Provisional application No. 60/307,897, filed on Jul. 26, 2001, and provisional application No. 60/394,142, filed on Jul. 5, 2002.

(51) Int. Cl.[7] ..... F16G 11/00; A44B 11/25

(52) U.S. Cl. ..... 24/68 R; 24/170; 24/134 R

(58) Field of Search ..... 24/68 R, 170, 24/134 R, 115 R, 265 CD, 132 AA, 132 WL, 69 R, 69 CT, 68 CD, 133

(56) References Cited

U.S. PATENT DOCUMENTS

| | | | | | |
|---|---|---|---|---|---|
| 1,079,080 | A | * | 11/1913 | Ward | 24/170 |
| 2,287,722 | A | | 6/1942 | Beazley | |
| 2,423,977 | A | * | 7/1947 | Hunter | 24/134 R |
| 2,538,641 | A | | 1/1951 | Elsner | |
| 2,845,674 | A | * | 8/1958 | Pearson | 24/134 KB |
| 3,678,542 | A | * | 7/1972 | Prete, Jr. | 24/191 |
| 4,148,224 | A | | 4/1979 | Craig | |
| 4,660,889 | A | | 4/1987 | Anthony et al. | |
| 4,727,628 | A | * | 3/1988 | Rudholm | 24/170 |
| 4,934,030 | A | * | 6/1990 | Spinosa et al. | 24/194 |
| 5,088,160 | A | * | 2/1992 | Warrick | 24/196 |
| 5,160,186 | A | * | 11/1992 | Lee | 297/479 |
| 5,392,535 | A | * | 2/1995 | Van Noy et al. | 36/88 |
| 5,423,108 | A | * | 6/1995 | Brennan | 24/134 R |
| 6,230,370 | B1 | * | 5/2001 | Nelsen | 24/68 CD |
| 6,295,700 | B1 | * | 10/2001 | Plzak | 24/134 R |
| 6,560,825 | B2 | * | 5/2003 | Maciejczyk | 24/170 |
| 2001/0039696 | A1 | | 11/2001 | Maciejczyk | |

FOREIGN PATENT DOCUMENTS

| | | |
|---|---|---|
| EP | 1 153 789 A2 | 11/2001 |
| WO | WO 00/30487 | 6/2000 |

* cited by examiner

*Primary Examiner*—Robert J. Sandy
*Assistant Examiner*—Andre' L. Jackson
(74) *Attorney, Agent, or Firm*—Barnes & Thornburg LLP

(57) ABSTRACT

A web adjuster device includes a frame defining a first web engaging surface. A web clamping member is movably mounted to the frame and defines second and third web engaging surfaces. A web is received between the first and second web engaging surfaces, and in one direction of web travel the web engages the third web engaging surface to force the second web engaging surface toward the first web engaging surface to trap the web therebetween. In an opposite direction, the web engages the third web engaging surface to force the second web engaging surface away from the first web engaging surface to allow web travel in this direction. The third web engaging surface may be omitted in favor of a web engaging protrusion extending from the web engaging surface of the frame, wherein the second web engaging surface facilitates trapping of the web against the web engaging protrusion.

17 Claims, 12 Drawing Sheets

WEB ADJUSTER DEVICE

CROSS-REFERENCE TO RELATED APPLICATIONS

This application claims priority to, and the benefit of, U.S. provisional patent application Ser. No. 60/307,897, filed Jul. 26, 2001, and U.S. provisional patent application Ser. No. 60/394,142, filed Jul. 5, 2002, the disclosures of which are each incorporated herein by reference.

FIELD OF THE INVENTION

The present invention relates generally to adjusters for controlling tension in a web, belt or strap, and more specifically to such adjusters configured to engage the web in one direction of web travel while allowing travel of the web in the opposite direction of web travel.

BACKGROUND AND SUMMARY OF THE INVENTION

This invention relates to the field of adjusters for controlling tension in a belt or web. One known pertinent prior art is commonly owned U.S. Pat. No. 4,660,889, the disclosure of which is incorporated herein by reference and attached hereto.

It is desirable to provide a web adjuster device configured to engage the web in one direction of web travel while allowing travel of the web in the opposite direction of web travel.

The present invention comprises one or more of the following features or combinations thereof. A web adjuster device having a frame with a bottom surface and an opposite top surface defining a first web engaging surface. The frame may include a pair of upstanding side walls extending upwardly away from the first web engaging surface. A web clamping member may be movably mounted to the frame between the pair of side walls, and the web clamping member may define a second web engaging surface and a third web engaging surface separate from the second web engaging surface. A web may extend into a first end of the frame through an opposite second end of the frame, with the web received between the sidewalls and between the first and second web engaging surfaces, and in contact with the third web engaging surface. When the web travels in a first direction through the device, it engages the third web engaging surface to force the second web engaging surface toward the first web engaging surface to trap the web therebetween. When the web travels in a second opposite direction through the device, it engages the third web engaging surface to force the second web engaging surface away from the first web engaging surface to allow web travel in the second opposite direction. The third web engaging surface may be maintained within the frame above the bottom surface of the frame through full range of movement of the web clamping member relative to the frame.

The web clamping member may be pivotally mounted to the frame between the upstanding sidewalls. The web adjuster device may further include a mounting plate defining a top surface and a pair of upstanding sidewalls extending upwardly away from the top surface of the mounting plate, with the mounting plate being mountable to the frame with the top surface thereof in contact with the bottom surface of the frame and with the web clamping member movably mounted between the upstanding sidewalls of the mounting plate. The first web engaging surface of the frame may define a plane, wherein the second opposite end of the frame defines a back wall extending upwardly away from the first web engaging surface and terminating at a top web-engaging edge positioned above the plane. The first and/or second web engaging surfaces may be configured to grip the web as the second web engaging surface of the web clamping member is forced toward the first web engaging surface of the frame. The web clamping member may include a handle portion configured for manual manipulation of the web clamping member.

The web adjuster device may further include a biasing mechanism mounted in contact with the web clamping member and the frame, with the biasing mechanism biasing the second web engaging surface of the web clamping member toward the first web engaging surface of the frame.

The web clamping member may include a protrusion extending toward the back wall of the frame, with the protrusion defining the third web engaging surface of the web clamping member. The web clamping member may alternatively include a protrusion extending downwardly toward the top surface of the frame, with the protrusion defining the third web engaging surface of the web clamping member. The protrusion may be located between the second web engaging surface and the handle portion.

Each of the sidewalls of the frame may define a channel therethrough, and the protrusion of the web clamping member may define a pin on opposite sides thereof, wherein the pins are received within the channels of the sidewalls to thereby limit movement of the web clamping member relative to the frame.

The frame may define a web receiving surface adjacent to a pair of upstanding side walls extending upwardly away from the web receiving surface, with the web receiving surface defining a web engaging protrusion extending away from the web receiving surface. The web traveling in a first direction through this device engages the web engaging surface of the web clamping member to force the web engaging surface of the web clamping member toward the web engaging protrusion of the frame to trap the web therebetween, and the web traveling in a second opposite direction through the device engages the web engaging surface of the web clamping member to force the web engaging surface of the web clamping member away the web engaging protrusion of the frame to allow web travel in the second opposite direction. The device may further include a biasing mechanism mounted in contact with the web clamping member and the frame, with the biasing mechanism biasing the engaging surface of the web clamping member toward the web engaging protrusion of the frame. The web clamping member may be configured such that the web engaging surface of the web clamping member is forced away from the web engaging protrusion of the frame by applying pressure on the handle portion in a direction toward the web receiving surface of the frame. The web clamping member may be alternatively configured such that the web engaging surface of the web clamping member is forced away from the web engaging protrusion of the frame by applying pressure on the handle portion in a direction away from the web receiving surface of the frame.

These and other features and objects of the present invention will become more apparent from the following description of the illustrative embodiments.

DESCRIPTION OF THE ILLUSTRATIVE EMBODIMENTS

Figure 1:
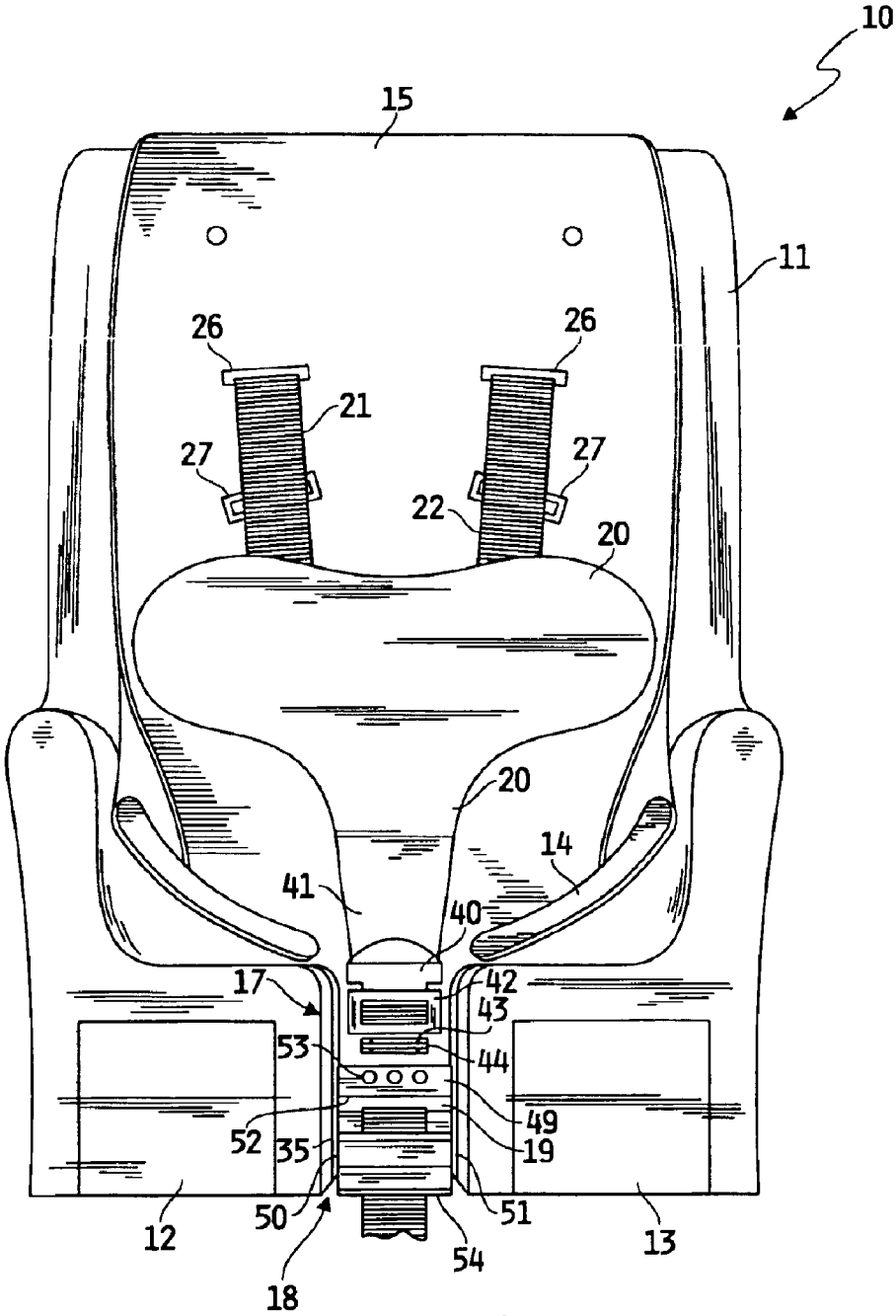
FIG. 1 is a front view of a child seat incorporating a web adjuster device of any of the types described herein.

For the purposes of promoting an understanding of the principles of the invention, reference will now be made to a number of embodiments illustrated in the drawings and specific language will be used to describe the same. It will nevertheless be understood that no limitation of the scope of the invention is thereby intended.

Figure 2:
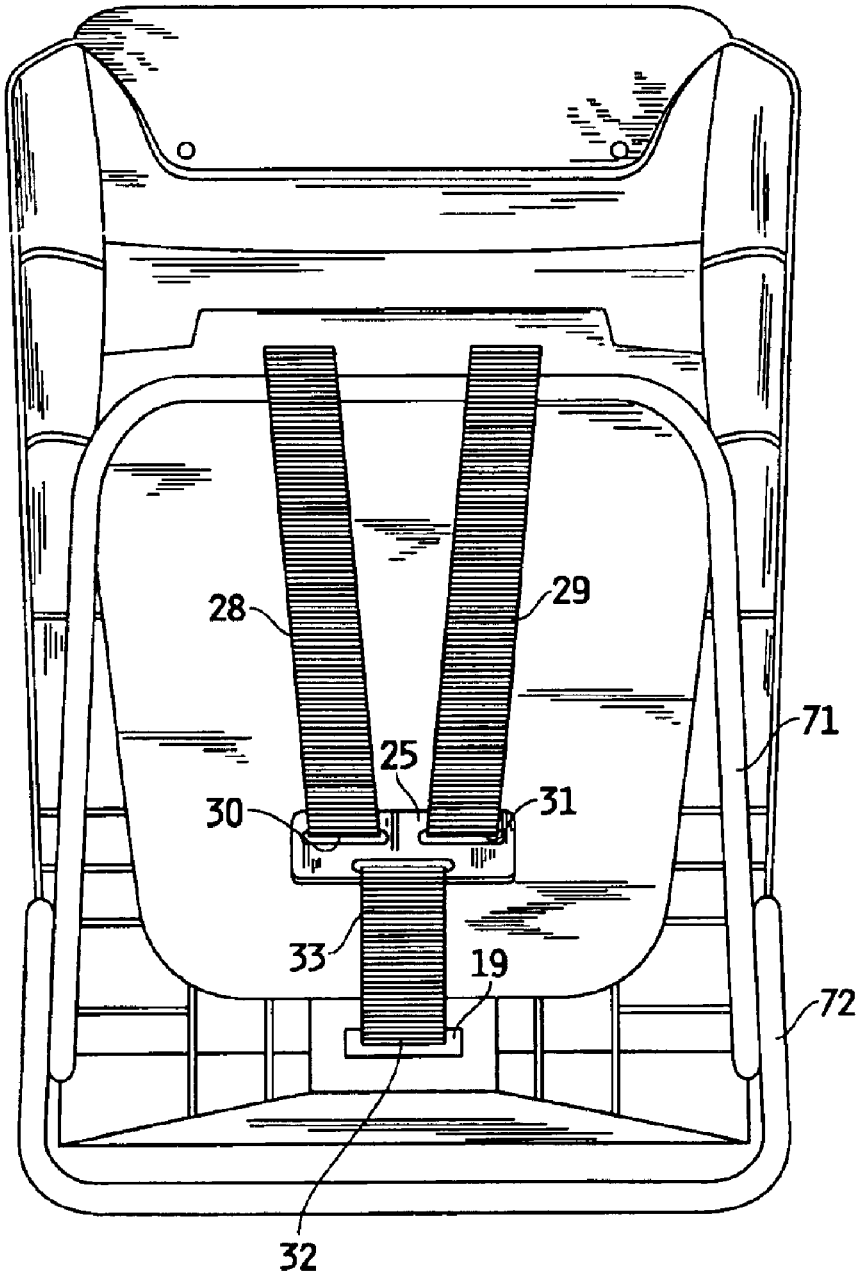
FIG. 2 is a rear view of the seat of FIG. 1.

Referring now to FIG. 1, there is shown a child's infant seat 10 for placing atop an automobile seat. Seat 10 includes a plastic main body 11 molded to receive a child in a sitting position. The seat portion 14 is generally concave in configuration and integrally joined to the back portion 15 both of which have positioned thereagainst a flexible and washable cushion. A groove 16 is provided in the front center portion of the seat with either front side 12 and 13 projecting forwardly thereof and against which the child's legs may be positioned. Positioned within groove 16 is the buckle/tongue and adjuster combination 17 for adjusting the harness assembly mounted to the seat. The harness assembly includes a pair of flexible webs, belts or straps 21 and 22 having first ends fixedly secured to pad 20 which is positionable adjacent the front of a child occupying seat 10. Belts 21 and 22 extend through either a pair of top slots 26 or bottom slots 27 to the back of the seat and are then secured to a moveable bar 25 (FIG. 2). Bar 25 is rigid, being made of metal or other suitable material, and includes a pair of slots 30 and 31, each of which has a outwardly opening channel to allow the bottom end portions 28 and 29 of the belts to be moved through the channel and mounted via slots 30 and 31 to the bar. Each bottom portion 28 and 29 includes a loop-constructed end to allow the belts to be disengaged from bar 25 in case the belts are to be withdrawn from slots 26 and extended through slots 27. The top slots 26 are utilized in the event the child is tall whereas the belts are extended through the bottom slots 27 for a shorter child. A moveable bar for such a purpose is disclosed in U.S. Design Pat. No. D285,383, which is assigned to the assignee of the present invention, and the contents of which are incorporated herein by reference. Fixedly secured to bar 25 between the belts is a third belt 32 having one end 33 affixed to the bar with the opposite end extending through slot 19 formed in the forward portion of the seat within groove 16. Belt 32 extends through slot 19 and is lockingly held by adjuster 35 fixedly mounted to the seat within groove 16.

The tongue/buckle/adjuster combination 17 includes a conventional metal tongue 40 fixedly mounted to the bottom tapered end 41 of pad 20. End 41 is sized to fit between the legs of a child occupying seat 10, whereas the enlarged upper end of the pad 20 is sized to rest against the chest and abdomen of the child. A conventional push button seat belt buckle 42 is mounted to a strap 43 in turn fixedly fastened to the seat within groove 16 by conventional fastening devices 44 such as rivets or the like. An alternate version of the FIG. 1 embodiment is identical except that the positions of the buckle and tongue are reversed. Tongue/buckle/ adjuster combination 45 includes a conventional push button seat belt buckle 46 fixedly secured to the bottom end 41 of pad 20 with a conventional tongue 47 secured to belt 48 in turn fastened to the seat in groove 16 by conventional fastening devices. Lower end 41 of the pad may be rigidly attached to buckle 46.

Figure 3A:
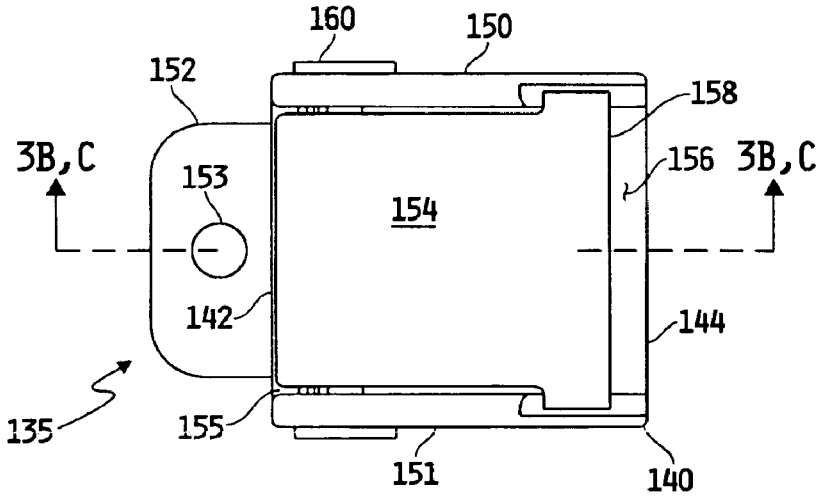
FIG. 3A is a top plan view of one illustrative embodiment of the web adjuster device illustrated in FIGS. 1 and 2.
Figure 3B:
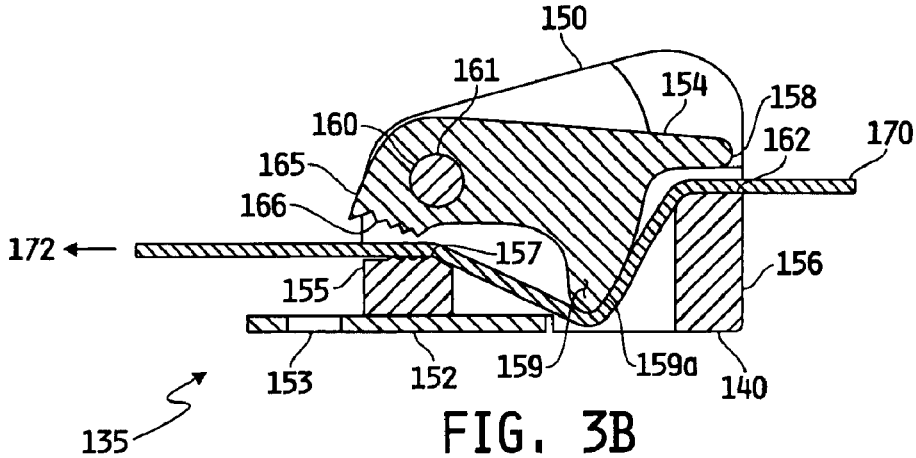
FIG. 3B is a cross-sectional view of the web adjuster device of FIG. 3A, viewed along section lines 3B,C—3B,C, illustrating the device in an open position to allow travel of a web therethrough.
Figure 3C:
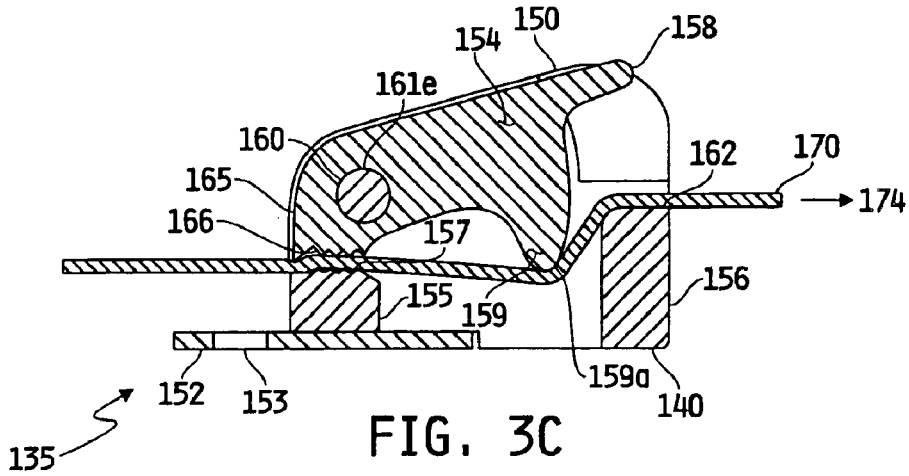
FIG. 3C is a cross-sectional view of the web adjuster device of FIG. 3A, viewed along section lines 3B,C—3B,C, illustrating the device in a closed position trapping a web therein.
Figure 3D:
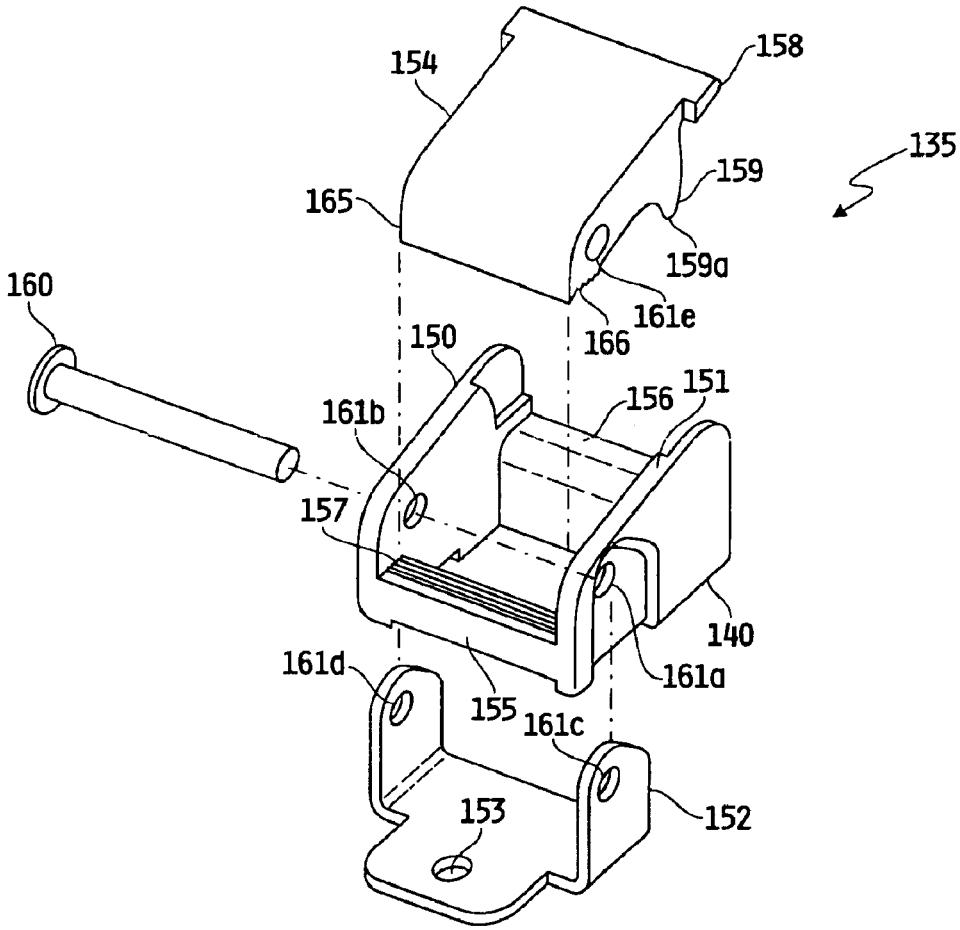
FIG. 3D is an exploded view of the web adjuster device of FIGS. 3A–3C illustrating various components thereof.

Referring now to FIGS. 3A–3D, one illustrative embodiment 135 of the web adjuster device 35 illustrated in FIGS. 1–2 is shown. Web adjuster device 135 generally includes a frame or webbing guide 140 and a web clamping member 154 transversely and movably mounted to the frame 140. The frame 140 is generally rectangular and comprises, generally, a first end 142 defining a first web engaging member 155, an opposite second end 144 defining a second web engaging member or back wall 156 and a pair of spaced apart sidewalls 150 and 151 extending therebetween. In one illustrative embodiment, as shown in FIGS. 3A–3D, device 135 includes a mounting plate 152 mounted to frame 140 and defining at least one opening 153 therethrough adapted to receive any conventional fastening device for mounting device 135 to desired structure such as, for example, seat 10 as depicted in FIG. 1. In the embodiment shown, mounting plate 152 includes a pair of upstanding sidewalls defining a pair of holes 161*c* and 161*d* therethrough that align with holes 161*a* and 161*b* defined through the upstanding sidewalls 151 and 150 respectively of frame 140 when the top surface of plate 152 is suitably positioned in contact with the bottom surface of frame 140 as shown in FIG. 3D. Alternatively, mounting plate 152 may be formed integral with frame 140. It is to be understood, however, that in applications wherein it is not desirable to mount device 135 to a structure, mounting plate 152 may be omitted. In cases where device 135 includes mounting plate 152, it is desirable to form plate 152 of a suitable mounting material. An example of one suitable material for forming plate 152 is steel or other metal composition, although the present invention contemplates forming plate 152 from any suitable rigid or flexible material.

Web engaging member 155 defines a first web engaging surface 157 and web engaging member 156 defines a second web engaging surface 162, wherein surface 162 extends generally further away from the bottom of frame 140 than does surface 157 as most clearly illustrated in FIGS. 3B and 3C. In other words, if the web engaging surface 157 defines a plane within frame 140, web engaging surface 162, defined by the top terminal edge of web engaging member 156, is positioned, relative to frame 140, generally above this plane. In one embodiment, as illustrated in FIGS. 3A–3D, web engaging surface 157 is ribbed, with any desired number of ribs extending generally between walls 150 and 151 to facilitate gripping of a web, belt or harness, although it will be appreciated that web engaging surface 157 may alternatively be enhanced with any desired profile and/or material adapted to facilitate engagement of a web in contact therewith. Examples of such profiles and/or material include, but are not limited to, a knurled surface, a toothed surface, a sheath of a suitable web engaging material disposed on surface 157, and the like. Alternatively, web engaging surface 157 may be generally smooth without adversely affecting the operation of device 135 as will be described in greater detail hereinafter. As further illustrated in FIGS. 3A–3D, it is desirable to configure web engaging surface 162 as a smooth surface for facilitating smooth travel over surface 162 of a web, although the present invention contemplates providing surface 162 with any desired profile.

In the illustrated embodiment, web clamping member 154 is pivotally attached to sides 150 and 151 of frame 140 via a pin 160. Web clamping member 154 defines a bore 161*e* therethrough, and pin 160 extends through holes 161*c* and 161*d* of mounting plate 152, through holes 161*a* and 161*b* of frame 140, and through bore 161*e* to thereby movably mount web clamping member 154 to frame 140, and to attach mounting plate 152 to frame 140. It will be appreciated that web clamping member 154 may be otherwise movably mounted to sidewalls 150 and 151 via suitable means. In any case, web clamping member 154 defines a first web engaging member or locking cam 165 disposed generally opposite web engaging member 155 of frame 140, and a second web engaging member, protrusion or projection 159 disposed generally between first and second web engaging members 155 and 156 of frame 140. In the illustrated embodiment, web engaging member 159 is generally arcuate-shaped, and extends generally away from the axis of rotation of web clamping . . . member 154 relative to frame 140. It will be appreciated, however, that web engaging member 159 may be configured with alternative shapes and/or be alternatively located relative to web clamping member 154. A handle portion or release actuator 158 extends from web clamping member 154 and is positioned generally adjacent to the second web engaging member 156 of frame 140. Handle portion 158 is configured to facilitate manual manipulation and adjustment of the web clamping member 154 relative to frame 140. Web engaging member 165 defines a web engaging surface 166, and in one embodiment surface 166 defines a plurality of ribs configured complementary to the web engaging surface 157 of web engaging member 155 of frame 140 as shown by example in FIGS. 3B–3D, although it is contemplated that web engaging surface 166 may be provided with other web engaging profiles and/or material adapted to facilitate gripping of a web, belt or harness in contact therewith as described hereinabove with respect to web engaging surface 157 of web engaging member 155. As further illustrated in FIGS. 3B–3D, it is desirable to configure the surface of web engaging member 159 as a smooth surface for facilitating smooth travel over this surface of a web, although it is contemplated web engaging member 159 may be provided with any desired surface profile.

As illustrated in FIGS. 3B and 3C, the web adjuster device 135 is adapted to receive therein from one end through its opposite end a web 170 extending between walls 150 and 151 of frame 140, and between web engaging surfaces 157 and 166, and generally in contact with web engaging surfaces 157 and 162 of web engaging members 155 and 156 respectively, and also generally in contact with a surface 159*a* of web engaging member or protrusion 159 in serpentine fashion, such that protrusion 159 slightly deflects web 170 as shown. Web adjuster device 135 is configured to allow movement or travel of web 170 therethrough along a first web travel direction, and to inhibit travel of web 170 therethrough along a second web travel direction by trapping, clamping or locking a portion of web 170 between web engaging surfaces 157 and 166 of web engaging members 155 and 165 respectively. For example, referring specifically to FIG. 3B, web adjuster device 135 is configured to allow travel of web 170 along a second web travel direction indicated by directional arrow 172. When web 170 travels in direction 172, web 170 applies a force to web engaging member 159 in such a manner to force web engaging member 165 away from web engaging member 155 thereby separating web engaging surface 166 from web engaging surface 157 as shown. In this position, web 170 may travel freely along direction 172, guided by sidewalls 150 and 151 and in general contact with web engaging members 156 and 159. Conversely, and referring now specifically to FIG. 3C, web adjuster device 135 is configured to inhibit travel of web 170 along a first web travel direction opposite to the web travel direction 170 illustrated in FIG. 38 as indicated In FIG. 3C by directional arrow 174. When web 170 travels in direction 174, web 170 applies a force to web engaging member 159 In such a manner to force web engaging member 165 toward web engaging member 155 thereby forcing web engaging surface 166 toward web engaging surface 157 and trapping or clamping a portion of web 170 therebetween as shown. In this position, web 170 is locked to device 135 and is therefore inhibited from traveling along direction 174. Any further force applied to web 170 in direction 174 serves to further urge or force web engaging surface 166 of web engaging member 165 toward web engaging surface 157 of web engaging member 155, thereby increasing the grip of web 170 therebetween. When it is desirable to allow free travel of web 170 through device 135 along either direction 172 or 174, handle portion 158 may be manually forced toward web engaging member 156. In the illustrated embodiment, for example, advancement of handle portion 158 toward web engaging member 156 causes rotation of web clamping member 154 relative to frame 140 in a manner that moves the web engaging surface 166 of web engaging member 165 away from the web engaging surface 157 of web engaging member 155, thereby permitting tree travel of web through device 170 along either direction 172 or 174, as illustrated in FIG. 3B. In this embodiment, the portion of web 170 extending beyond web engaging member 156 represents a tension end of the web 170, and the portion of web 170 extending beyond web engaging member 155 represents a free end of the web 170.

In one embodiment, frame 140 and web clamping member 154 are formed from a rigid polymer, although the present invention contemplates that frame 140 and/or web clamping member may alternatively be formed from any suitable rigid material such as steel or other metal alloy, plastic resin, nylon, or the like, and/or from any suitable flexible material such as rubber, or the like. In general, the profiles of web engaging surfaces 157 and 166 of web engaging members 155 and 165 respectively may be variously configured, taking into account the material composition of frame 140 and web clamping member 154 and the web load force capacities thereof as well as web integrity concerns. For example, in cases where frame 140 and web clamping member 154 are both formed of a polymer material, it may be desirable to provide both surfaces 157 and 166 with web engaging profiles as illustrated in FIGS. 3B–3C in order to share the web load force under web locking conditions between frame 140 and web clamping member 154. With such materials, damage to web 170 due to repeated gripping between surfaces 157 and 166 will likely be minimal as compared with metal components, and providing both surfaces 157 and 166 with web engaging profiles will therefore generally not be a concern. However, in cases where both frame 140 and web clamping member 154 are formed of steel or other metal alloy, potential web damage due to repeated gripping between surfaces 157 and 166 may be a greater concern, and load sharing between frame 140 and web clamping member 154 less of a concern. In such cases, it may accordingly be desirable to configure only one of the surfaces 157 and 166 with a web engaging profile while configuring the remaining surface with a smooth profile. With this configuration, more web load force will typically be borne by the component having a web engaging surface, yet web damage will be minimized. The present invention accordingly contemplates myriad combinations of surface profiles for web engaging surfaces 157 and 166, and any such combinations are intended to fall within the scope of the present invention.

In any case, it is desirable in some embodiments to configure web clamping member 154 such that web engaging member or protrusion 159 is maintained within the frame 140 above the bottom surface thereof through the full range of movement of web clamping member 154 relative to frame 140.

Referring now to FIGS. 4A–4D, an alternate embodiment 235 of the web adjuster device 35 illustrated in FIGS. 1–2 is shown. Web adjuster device 235 is structurally similar and functionally identical to web adjuster device 135 just described with respect to FIGS. 3A–3D, and the foregoing discussion relating to device 135 applies directly to device 235. To facilitate an understanding of device 235, like numbers are used to identify like components of device 135, such numbers differing only by a factor of 100. Thus, for example, web engaging surface 257 of device 235 corresponds to web engaging surface 157 of device 135. The description of such like components of embodiment 235 will not be repeated here for brevity.

Figure 4A:
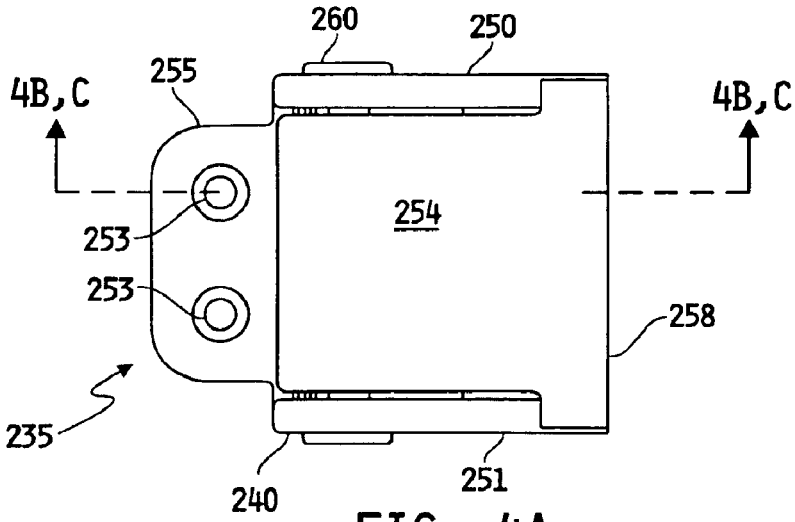
FIG. 4A is a top plan view of an alternate embodiment of the web adjuster device illustrated in FIGS. 1 and 2.
Figure 4B:
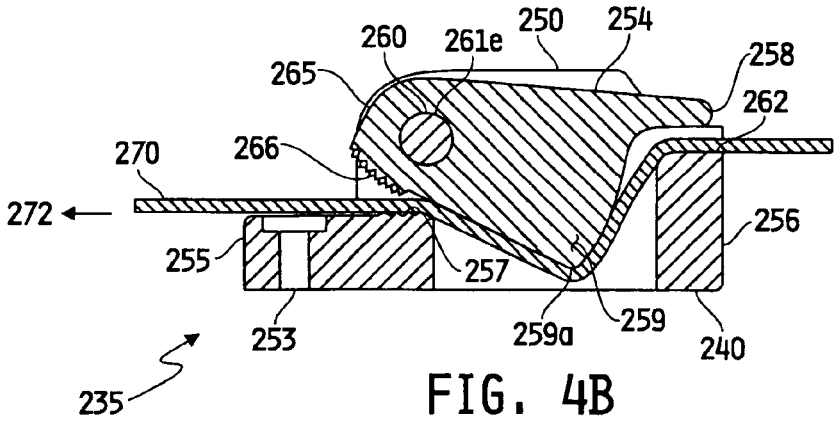
FIG. 4B is a cross-sectional view of the web adjuster device of FIG. 4A, viewed along section lines 4B,C—4B,C, illustrating the device in an open position to allow travel of a web therethrough.
Figure 4C:
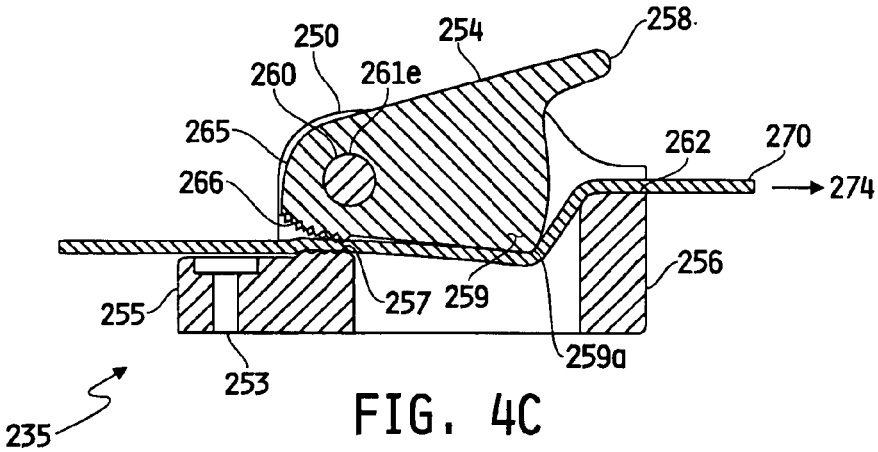
FIG. 4C is a cross-sectional view of the web adjuster device of FIG. 4A, viewed along section lines 4B,C—4B,C, illustrating the device in a closed position trapping a web therein.
Figure 4D:
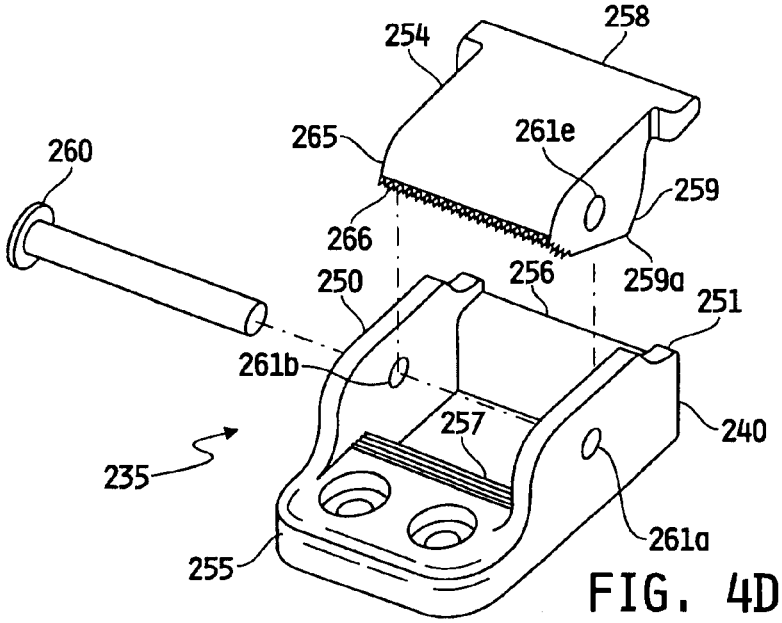
FIG. 4D is an exploded view of the web adjuster device of FIGS. 4A–4C illustrating various components thereof.

Unlike device 135, frame 240 of device 235 is preferably of uniform construction as most clearly shown in FIGS. 4B–4D. In this embodiment, frame 240 and web clamping member 254 are preferably formed of steel or other metal alloy, although either may alternatively be formed of other suitable materials as described hereinabove with respect to device 135.

Referring now to FIGS. 5A–5E, another alternate embodiment 335 of the web adjuster device 35 illustrated in FIGS. 1–2 is shown. As with web adjuster device 235, web adjuster device 335 is structurally similar and functionally identical to web adjuster device 135 just described with respect to FIGS. 3A–3D, and the foregoing discussion relating to device 135 accordingly applies directly to device 335. To facilitate an understanding of device 335, like numbers are used to identify like components of device 135, such numbers differing only by a factor of 200. Thus, for example, web clamping member 354 of device 335 corresponds to web clamping member 154 of device 135. The description of such like components of embodiment 335 will not be repeated here for brevity.

Unlike device 135, frame 340 of device 335 is of uniform construction as most clearly shown in FIGS. 5B–5E, and web engaging surface 357 is configured to have a substantially smooth profile for reasons described hereinabove. In this embodiment, frame 340 and web clamping member 354 are illustratively formed of steel or other metal alloy, although either may alternatively be formed of other suitable materials as described hereinabove with respect to device 135. Frame 340 is, in the illustrated embodiment, a unitary component having a bottom portion defining web engaging surface 357 and a raised back wall 356 terminating at a wall edge 362. The web engaging member or protrusion 359, in this embodiment, extends generally rearwardly from the web engaging surface 366 of web engaging member 365 toward back wall 356, to facilitate manipulation of web engaging surface 366 relative to web engaging surface 357 as described hereinabove with respect to embodiment 135.

Figure 5A:
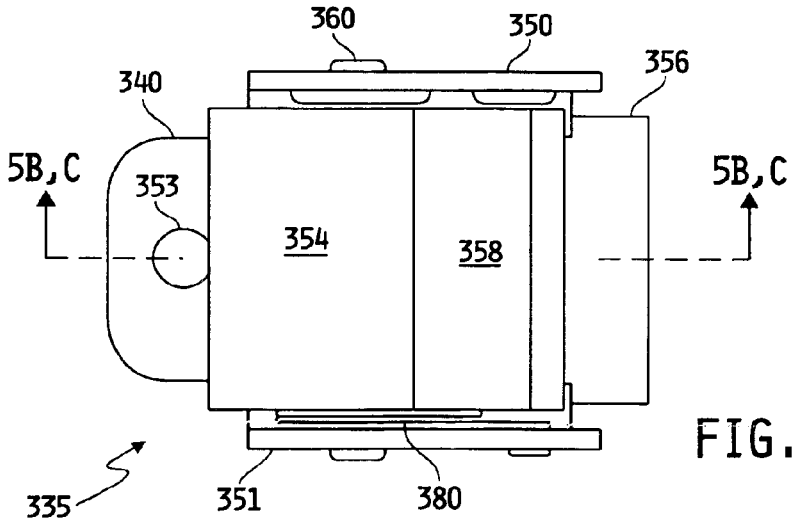
FIG. 5A is a top plan view of another alternate embodiment of the web adjuster device illustrated in FIGS. 1 and 2.
Figure 5B:
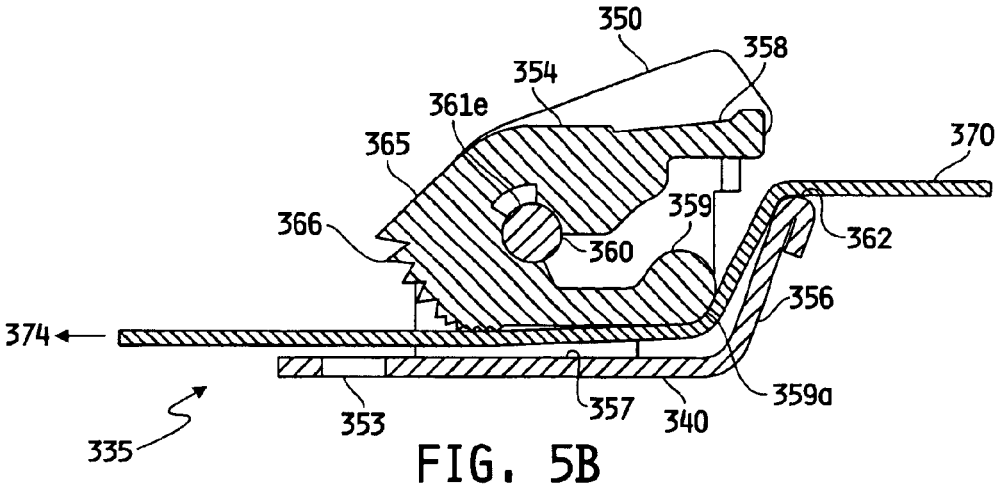
FIG. 5B is a cross-sectional view of the web adjuster device of FIG. 5A, viewed along section lines 5B,C—5B,C, illustrating the device in an open position to allow travel of a web therethrough.
Figure 5C:
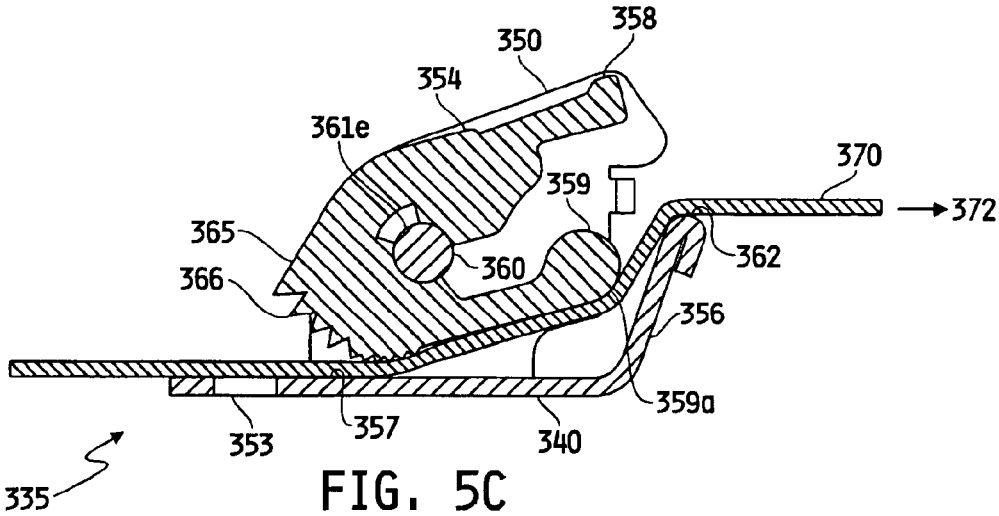
FIG. 5C is a cross-sectional view of the web adjuster device of FIG. 5A, viewed along section lines 5B,C—5B,C, illustrating the device in a closed position trapping a web therein.
Figure 5D:
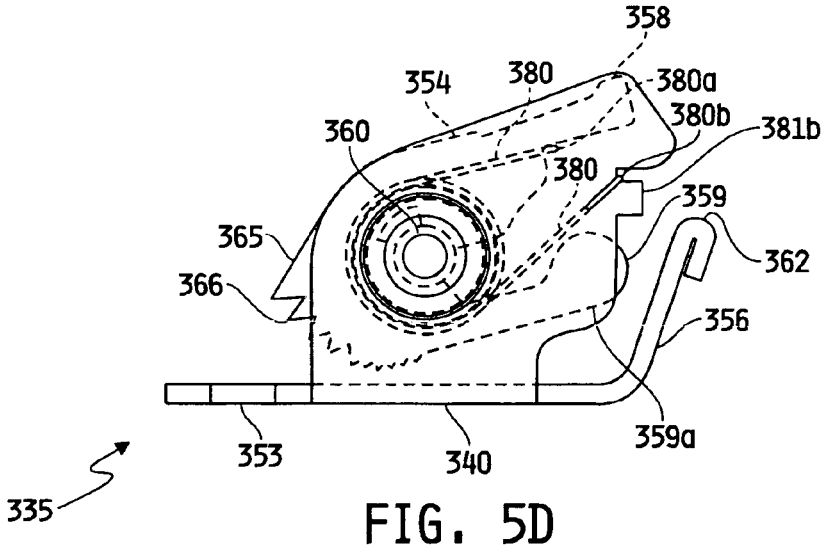
FIG. 5D is a side elevational view of the web adjuster device of FIGS. 5A–5C illustrating optional inclusion therein of a biasing spring.
Figure 5E:
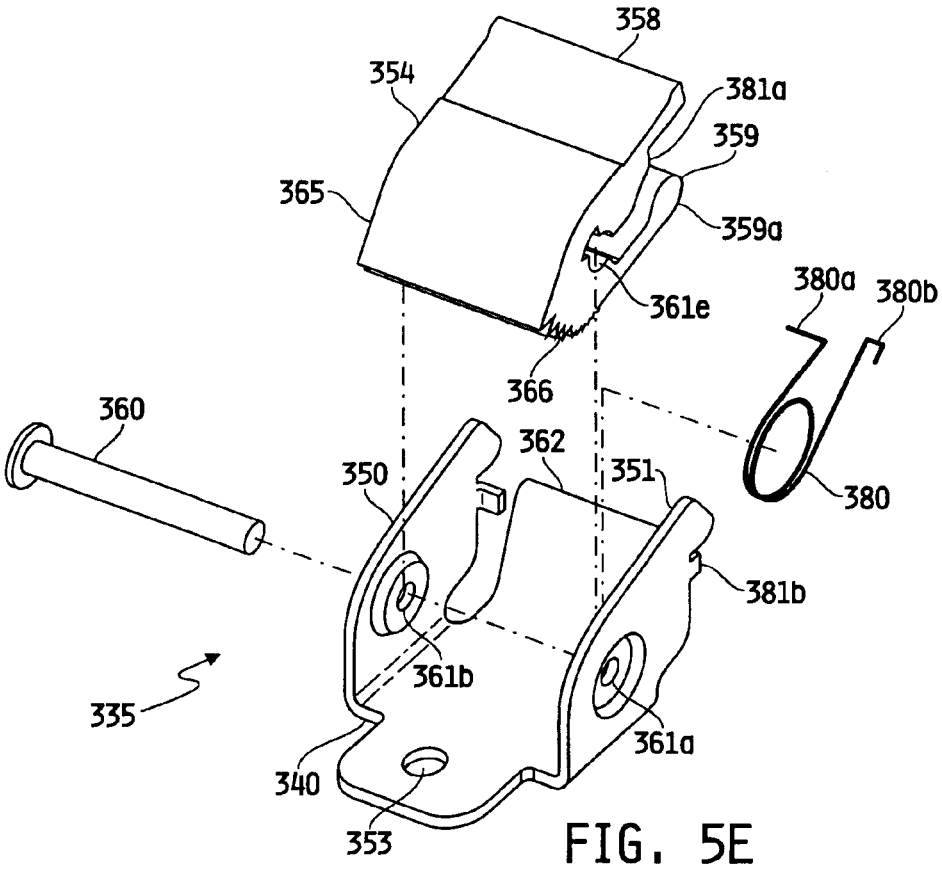
FIG. 5E is an exploded view of the web adjuster device of FIGS. 5A–5D illustrating various components thereof.

Device 335 illustrated in FIGS. 5A–5E optionally includes a so-called "user awareness" feature that may also be optionally included with any of the web adjuster device embodiments described herein. Specifically, device 335 may include a biasing spring 380 or other resilient member disposed in resilient contact between frame 340 and the web clamping member 354 and generally operable to bias the web engaging member 365 toward web engaging surface 357 of frame 340 as most clearly illustrated in FIG. 5D. In the illustrated embodiment, web clamping member 354 defines a wall portion 381*a* configured to engage a flat-bent portion 380*a* of spring 380, and frame 340 defines a tab or ear 381*b* configured to receive and engage a hooked portion 380*b* of spring 380. Spring 380, web clamping member 354 and frame 340 are configured such that the handle portion 358 of web clamping member 354 is biased upwardly away from rear wall 356 when device 335 is assembled, as illustrated in FIGS. 5C and 5D. In this embodiment, web engaging surface 366, if configured with a web engaging profile, is configured to allow travel of web 370 along web travel direction 374 when web clamping member 354 is biased as just described. It is to be understood that spring 380 is optional, and without it device 335 is operable in an identical manner to that described with respect to devices 135 and 235. If desired, spring 380 may be included as a user awareness feature to provide the user with a visual indication of the direction that handle portion 358 must be moved to allow free movement of web 370 within and through device 335. For example, with the handle portion 358 of web clamping member 354 biased upwardly as shown most clearly in FIG. 5D, a user can tell at a glance that the handle portion 358 must be moved toward frame 340/web 370 in order to permit free movement of web 370 within and through device 335.

Figure 6A:
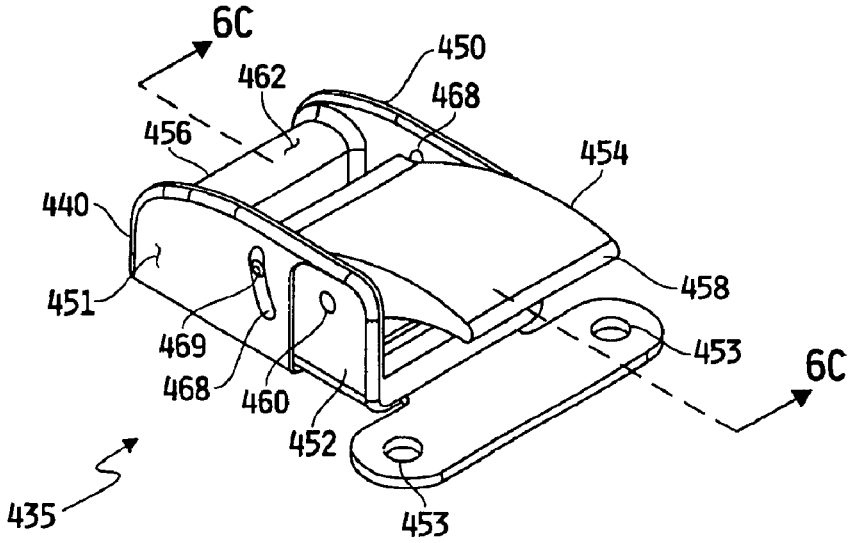
FIG. 6A is a top plan view of yet another alternate embodiment of the web adjuster device illustrated in FIGS. 1 and 2.
Figure 6B:
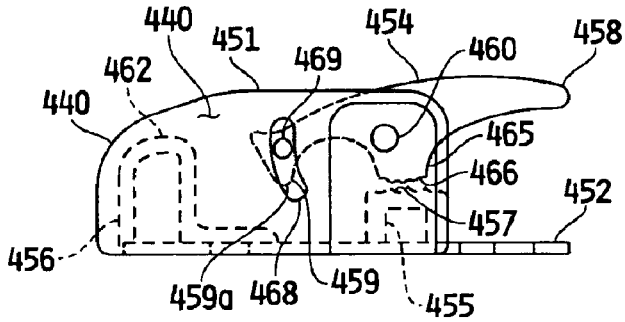
FIG. 6B is a side elevational view of the web adjuster device of FIG. 6A illustrating various components thereof.
Figure 6C:
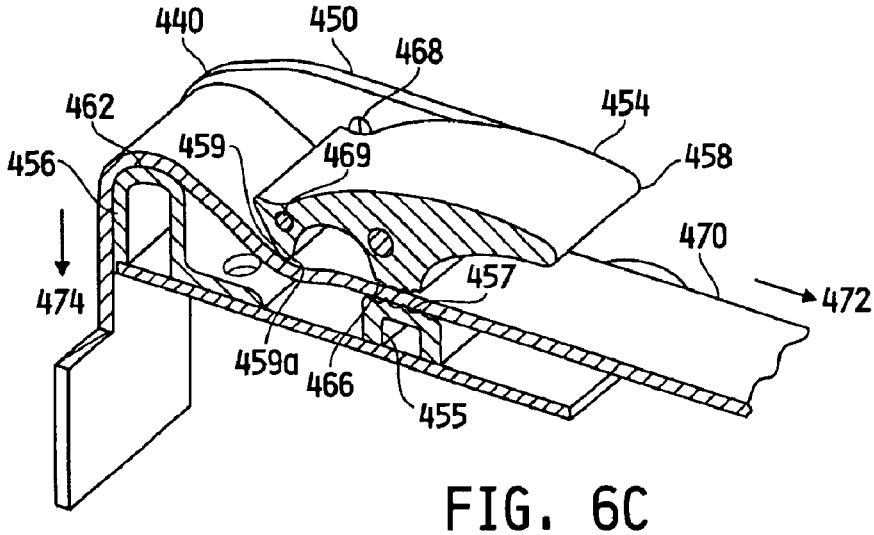
FIG. 6C is a side cutaway view of the web adjuster device of FIGS. 6A–6B illustrating operation thereof.

Referring now to FIGS. 6A–6C, yet another alternate embodiment 435 of the web adjuster device 35 illustrated in FIGS. 1–2 is shown. Web adjuster device 435 is structurally and functionally similar to web adjuster device 135 just described with respect to FIGS. 3A–3D, and much of the foregoing discussion relating to device 135 accordingly applies directly to device 435. To facilitate an understanding of device 435, like numbers are used to identify like components of device 135, such numbers differing only by a factor of 300. Thus, for example, web clamping member 454 of device 435 corresponds to web clamping member 154 of device 135. The description of such like components of embodiment 435 will not be repeated here for brevity.

Like device 135, device 435 optionally includes a mounting plate 452 defining one or more openings 453 therethrough, wherein two such openings 453 are illustrated in FIG. 6A. It is to be understood that device 435 need not include mounting plate 452, although inclusion of plate 452 may be desirable to provide a suitable mechanism for affixing device 435 to another structure as described hereinabove with respect to device 135.

Unlike device 135, each of the sidewalls 450 and 451 define a channel 468 therethrough between the web engaging members 455 and 456. Web clamping member 454 includes a pair of pins 469, with each one extending transversely from an opposite side of the web engaging member or protrusion 459 and received within corresponding channels 468. Channels 468 are configured to limit movement of the web clamping member 454 relative to frame 440. The handle portion 458 of web clamping member 454 is oriented oppositely to that described with respect to devices 135, 235 and 335, and travel of web 470 through device 435 is likewise opposite to that described with respect to devices 135, 235 and 335. With the aid of FIG. 6C, it should be apparent that web travel along the direction indicated by arrow 472 is allowed by device 435 since this action causes the web 470 to contact the surface 459*a* of the web engaging member 459 in such a manner to force pins 468 along channels 469 toward mounting plate 452, thereby forcing the web engaging surface 466 of web clamping member 454 away from the web engaging surface 457 of frame 440. Conversely, web travel along the direction indicated by arrow 474 is inhibited by device 435 since this action causes the web 470 to contact web engaging member 459 in such a manner to force pins 468 upwardly within channels 469 away from mounting plate 452, thereby forcing the web engaging surface 466 of web clamping member 454 toward the web engaging surface 457 of frame 440 and trapping a portion of web 470 therebetween. Unlike devices 135, 235 and 335 described hereinabove, free travel of web 470 through device 435 is made possible by applying an upward force to handle portion 458 of web clamping member 454; i.e., by forcing handle portion 458 away from mounting plate 452, thereby separating the web engaging surface 466 from the web engaging surface 457. In one embodiment, mounting plate 452 and web clamping member 454 are formed of steel or other metal alloy and frame 440 is formed of a polymer material, although other material compositions and combinations for mounting plate 452, web clamping member 454 and frame 440 are contemplate as described hereinabove with respect to device 135.

Figure 7:
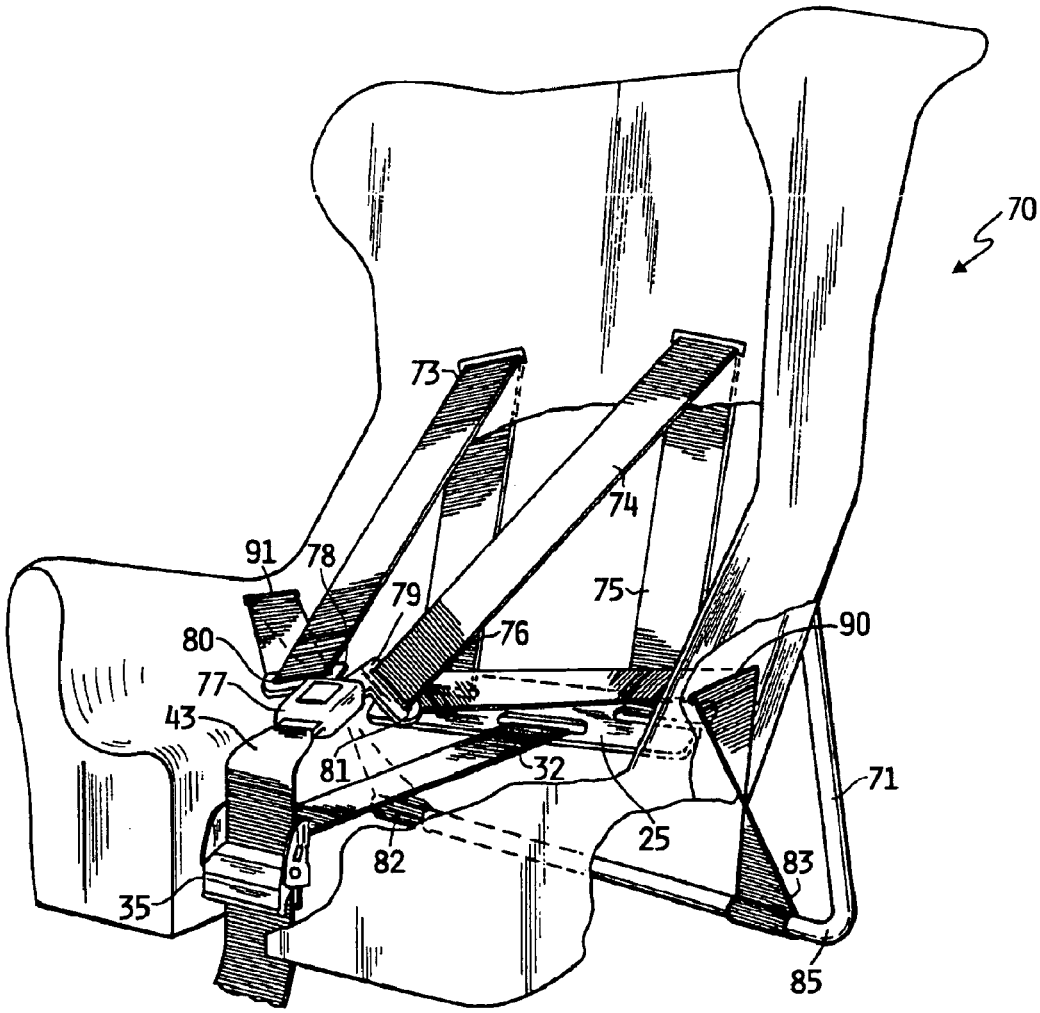
FIG. 7 is a perspective view of the seat shown in FIGS. 1 and 2 provided with an alternate embodiment of the harness assembly.

A further embodiment of a child seat and accompanying harness assembly is shown in FIG. 7. Seat 70 is identical to seat 10 of FIGS. 1 and 2 with the exception that the harness assembly is slidably attached to a split tongue and then fixedly secured to the tubular metal frame supporting the main body of the seat. Main body 11 of seat 10 (FIG. 2) is fixedly secured by conventional fasteners to a tubular frame 71 which is attached to the back 15 of the seat and extends between the back surface of the seat and belts 21 and 22. The bottom end of tubular frame 71 is fixedly secured to and beneath seat 14 by conventional fasteners. Suitable hinge or adjustment means 72 may be provided to allow the seat to be tilted at various angles. Such tubular frames are commercially known.

The harness of seat 70 includes a pair of belts 73 and 74 having bottom ends 75 and 76 with loops thereon extending into a pair of slots on bar 25 in a manner identical to that previously described for the embodiment shown in FIG. 1. The main body of the seat 70 is shown in dashed line configuration in order to more clearly illustrate the design of the harness assembly. Likewise, belt 32 of the harness is fixedly secured by a loop to bar 25 and extends forwardly through a slot in the front portion of the seat being lockingly secured by web adjuster 35 in a manner identical to that previously described for the embodiment of FIG. 1, wherein web adjuster 35 may be implemented as any one of the embodiments 135, 235, 335 or 435 described herein. Likewise, seat belt buckle 77 is secured to a belt 43 attached either directly to the seat or fixedly to the adjuster as previously described.

Seat belt buckles are well known which receive a pair of tongues in lieu of a single tongue. Tongues 78 and 79 are each provided with a closed slot 80 and 81, respectively, which slidably receive belts 73 and 74, respectively. The forward projecting portion of each tongue 78 and 79 is lockingly received by buckle 77. The belts extend slidably through slots 80 and 81 having bottom ends 82 and 83 fixedly secured to the laterally extending bottom portion 85 of tubular frame 71. Slots 90 and 91 are provided in the arms of the chair for, respectively, belts 73 and 74 to slide therethrough. The harness assembly for seat 70 is not provided with an abdominal pad 20 and instead belts 73 and 74 rest adjacent the chest and abdomen of the child. It is desirable to provide a sufficient length of belt 43 to position buckle 77 upwardly from the normal downward position shown for seat 10 in FIG. 1.

Referring now to FIGS. 8A–8E, still another alternate embodiment 535 of the web adjuster device 35 illustrated in FIGS. 1–2 is shown. As with web adjuster devices 235, 335 and 435, web adjuster device 535 is structurally similar and functionally identical to web adjuster device 135 just described with respect to FIGS. 3A–3D, and the foregoing discussion relating to device 135 accordingly applies directly to device 535. To facilitate an understanding of device 535, like numbers are used to identify like components of device 135, such numbers differing only by a factor of 400. Thus, for example, web clamping member 554 of device 535 corresponds to web clamping member 154 of device 135, and so forth. The description of such like components of embodiment 535 will not be repeated here for brevity.

Figure 8A:
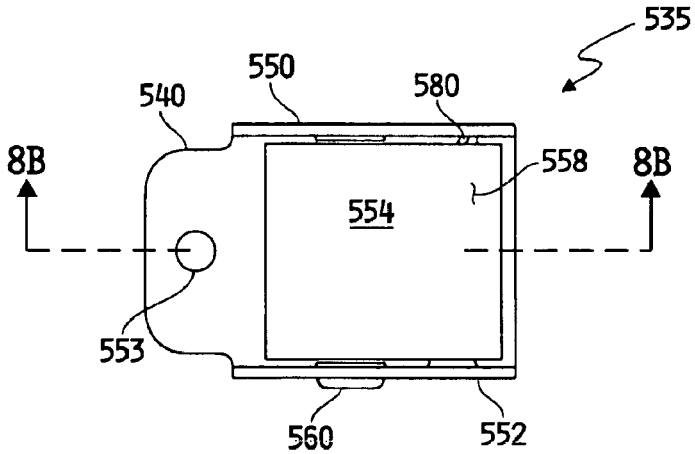
FIG. 8A is a top plan view of still another alternate embodiment of the web adjuster device illustrated in FIGS. 1 and 2.
Figure 8B:
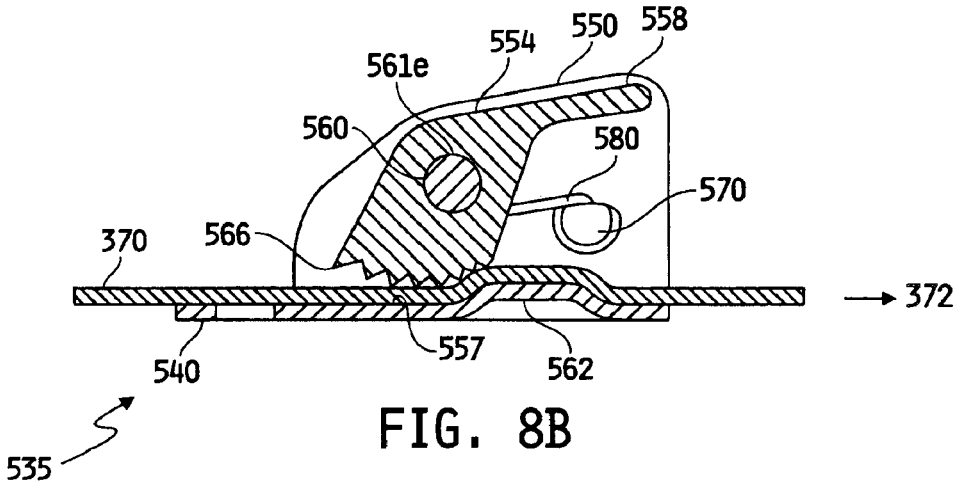
FIG. 8B is a cross-sectional view of the web adjuster device of FIG. 8A, viewed along section lines 8B—8B, illustrating the device in a closed position trapping a web therein.
Figure 8C:
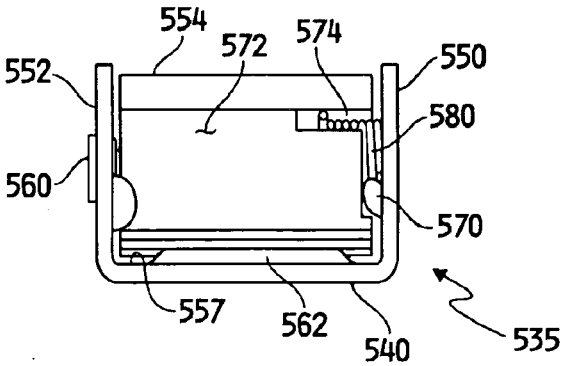
FIG. 8C is a rear elevational view of the web adjuster device of FIGS. 8A–8B illustrating optional inclusion therein of a biasing spring.
Figure 8D:
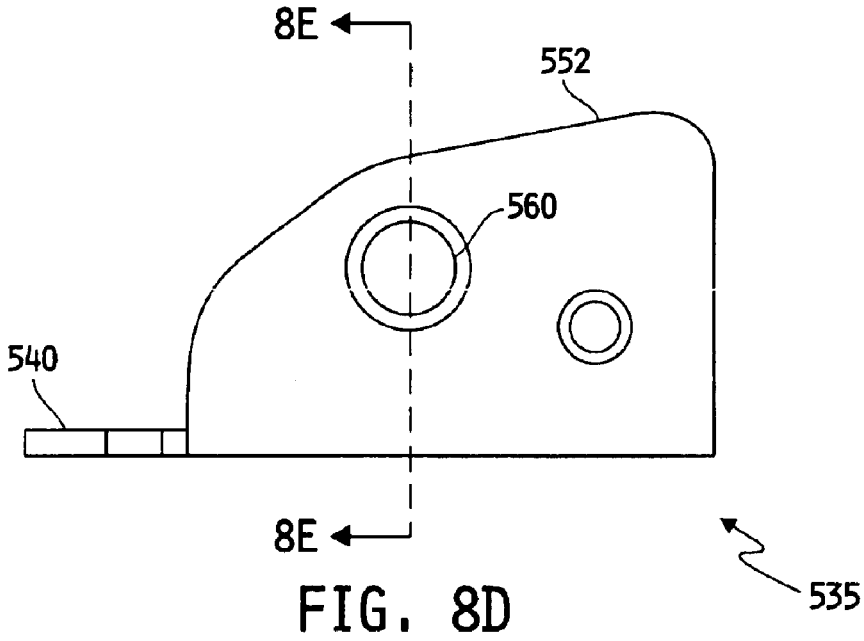
FIG. 8D is a side elevational view of the web adjuster device of FIGS. 8A–8C.
Figure 8E:
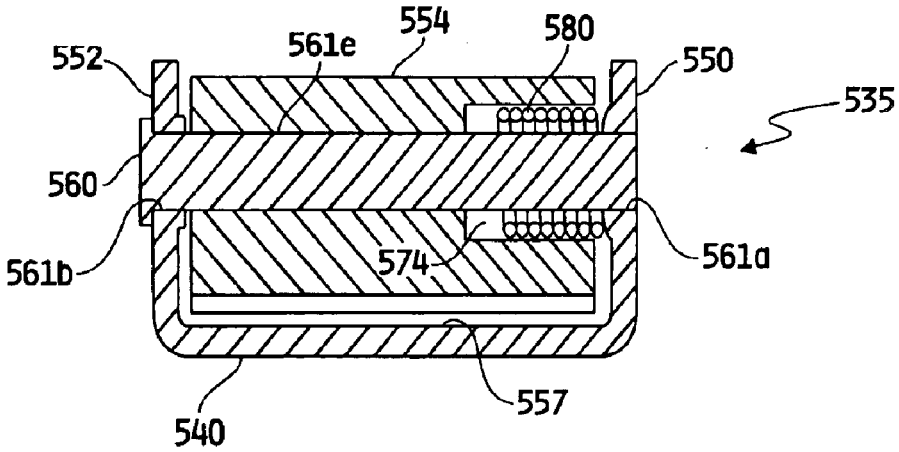
FIG. 8E is a cross-sectional view of the web adjuster device of FIGS. 8A–8D, viewed along section lines 8E—8E, further illustrating optional inclusion therein of a biasing spring.

Unlike device 135, frame 540 of device 535 is preferably of uniform construction as most clearly shown in FIGS. 8B, 8C and 8E. Web receiving and/or engaging surface 557 of frame 540 may be configured to have a substantially smooth profile for reasons described hereinabove, or may alternatively include a web engaging protrusion 562 positioned to contact the web engaging surface 566 of the web clamping member 554. In this embodiment, frame 540 and web clamping member 554 may be formed of steel or other metal alloy, although either may alternatively be formed of other suitable materials as described hereinabove with respect to device 135.

As with device 335, device 535 may include a biasing spring 580 or other suitable biasing member disposed in resilient contact between frame 540 and the web clamping member 554 and generally operable to bias the web engaging surface 566 of web clamping member 554 toward web engaging surface 557 and web engaging protrusion 562 of frame 540, as most clearly illustrated in FIGS. 8B, 8C and 8D. In this embodiment, web engaging surface 566, if configured with a web engaging or gripping profile as illustrated in FIGS. 8B and 8C, is configured to inhibit travel of web 370 in the direction 372, as illustrated in FIG. 8B. In the opposite direction (not shown), the web engaging surface 566 (and web engaging protrusion 562 of frame 540) is configured to allow web 370 to travel therethrough as described hereinabove. It is to be understood that the web engaging surface 566 of web clamping member 554 and/or protrusion 562 forming at least part of the web engaging surface 557 of frame 540 may be configured with a smooth surface, or may alternatively be provided with any desired web-gripping structure or profile to facilitate gripping of web 370 along the direction 372, and to facilitate travel of web 370 through device 535 in the opposite direction.

In embodiments of device 535 that include biasing member 580, it is desirable to configure device 535 to incorporate biasing member 580 in a manner that simplifies manufacture of device 535 while also satisfying the desired biasing function. In one embodiment, web clamping member 554 accordingly defines a channel 574 configured to sliding receive biasing member 580 therein, as most clearly shown in FIGS. 8C and 8E. One end of the biasing member 580 is biased against a surface of the channel 574 defined by the web clamping member 554, and the opposite end of the biasing member 580 is biased against frame 540. In the illustrated embodiment the frame 540 may include a suitably positioned ear or tab 570 configured to engage one end of the biasing member 580. In the illustrated embodiment, the biasing member 580 is positioned relative to the device 535 so as to bias the web engaging surface 566 of the web clamping member 558 toward the web engaging surface 557 (and protrusion 562) of the frame 540 while also biasing the handle portion 558 in a direction generally upwardly and away from the web engaging surface 557 of frame 540. With this configuration, downward pressure on the handle portion 558; i.e., pressure on the handle portion in a direction generally toward the web engaging surface 557 of frame 540, is required to force the web engaging surface 566 of the web clamping member 558 away from the web engaging surface 557 (and protrusion 562) of frame 540. Alternatively, the biasing member 580 may positioned relative to the device 535 so as to bias the web engaging surface 566 of the web clamping member 558 toward the web engaging surface 557 (and protrusion 562) of the frame 540 while also biasing the handle portion 558 in a direction generally downwardly and toward the web engaging surface 557 of frame 540. With this configuration, upward pressure on the handle portion 558; i.e., pressure on the handle portion in a direction generally away from the web engaging surface 557 of frame 540, is required to force the web engaging surface 566 of the web clamping member 558 away from the web engaging surface 557 (and protrusion 562) of frame 540.

Unlike device 335, the frame 540 of device 535 does not include a back portion, i.e., a raised portion adjacent to handle portion 558. The position and configuration of the web engaging surface 562 of the web clamping member 554 relative to the position and configuration of the protrusion 562 defining the web engaging surface of the frame 540 is designed to suitably trap and lock web 370 therebetween in the direction 372, and to allow travel of web 370 in the opposite direction, thereby obviating any need for a back portion of frame 540.

Figure 9A:
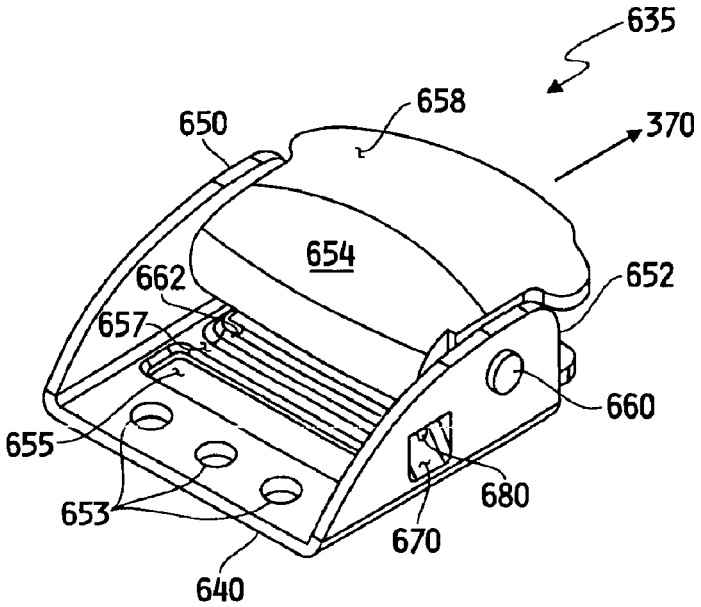
FIG. 9A is a perspective view of a further alternate embodiment of the web adjuster device illustrated in FIGS. 1 and 2.
Figure 9B:
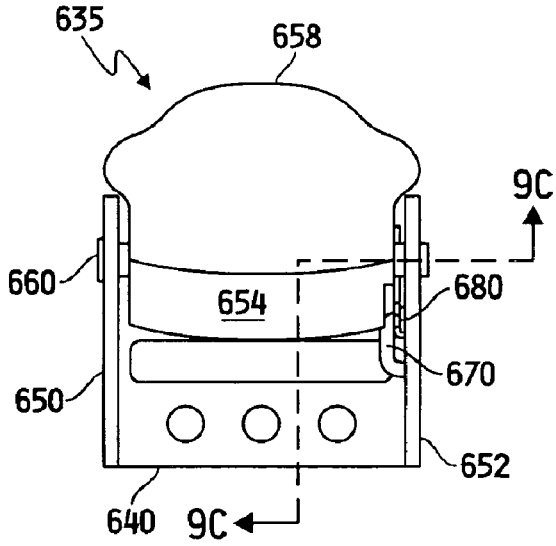
FIG. 9B is a top plan view of the web adjuster device of FIG. 9A.
Figure 9C:
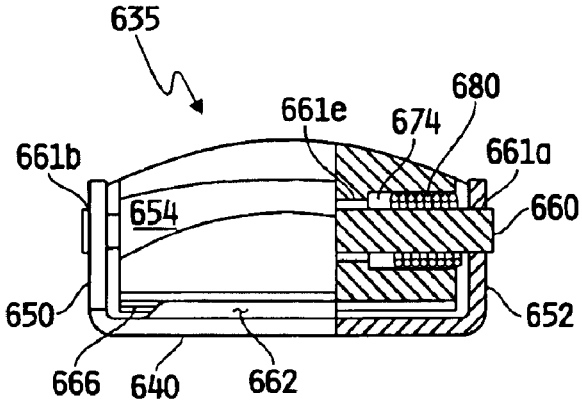
FIG. 9C is a cross-sectional view of the web adjuster device of FIGS. 9A–9B, viewed along section lines 9C—9C, illustrating optional inclusion therein of a biasing spring.

Referring now to FIGS. 9A–9C, still another alternate embodiment 635 of the web adjuster device 35 illustrated in FIGS. 1–2 is shown. As with web adjuster devices 235, 335, 435 and 535, web adjuster device 635 is structurally similar and functionally identical to web adjuster device 135 just described with respect to FIGS. 3A–3D, and the foregoing discussion relating to device 135 accordingly applies directly to device 635. To facilitate an understanding of device 635, like numbers are used to identify like components of device 135, such numbers differing only by a factor of 500. Thus, for example, web clamping member 654 of device 635 corresponds to web clamping member 154 of device 135, and so forth. The description of such like components of embodiment 635 will not be repeated here for brevity.

Unlike device 135, frame 640 of device 635 is preferably of uniform construction as most clearly shown in FIGS. 9A and 9C. Web receiving and/or engaging surface 657 of frame 640 may be configured to have a substantially smooth profile for reasons described hereinabove, or may alternatively include a web engaging protrusion 662 positioned to contact the web engaging surface 666 of the web clamping member 654. In this embodiment, frame 640 and web clamping member 654 may be formed of steel or other metal alloy, although either may alternatively be formed of other suitable materials as described hereinabove with respect to device 135.

As with devices 335 and 535, device 635 may include a biasing spring 680 or other suitable biasing member disposed in resilient contact between frame 640 and the web clamping member 654 and generally operable to bias the web engaging surface 666 of web clamping member 654 toward web engaging surface 657 and web engaging protrusion 562 of frame 640. In this embodiment, web engaging surface 666, if configured with a web engaging or gripping profile as illustrated in FIG. 9C, is configured to inhibit travel of web in the direction 372, as illustrated in FIG. 9A. In the opposite direction (not shown), the web engaging surface 666 (and web engaging protrusion 662 of frame 640) is configured to allow the web to travel therethrough as described hereinabove. It is to be understood that the web engaging surface 666 of web clamping member 654 and/or protrusion 662 forming at least part of the web engaging surface 657 of frame 640 may be configured with a smooth surface, or may alternatively be provided with any desired web-gripping structure or profile to facilitate gripping of the web along the direction 372, and to facilitate travel of the web through device 635 in the opposite direction.

In embodiments of device 635 that include biasing member 680, it is desirable to configure device 635 to incorporate biasing member 680 in a manner that simplifies manufacture of device 635 while also satisfying the desired biasing function, as described hereinabove with respect to device 535. In one embodiment, web clamping member 654 accordingly defines a channel 674 configured to sliding receive biasing member 680 therein, as most clearly shown in FIG. 9C. One end of the biasing member 680 is biased against a surface of the channel 674 defined by the web clamping member 654, and the opposite end of the biasing member 680 is biased against frame 640. In the illustrated embodiment, the frame 640 may include a suitably positioned ear or tab 670 configured to engage one end of the biasing member 680. In the illustrated embodiment, the biasing member 680 is positioned relative to the device 635 so as to bias the web engaging surface 666 of the web clamping member 658 toward the web engaging surface 657 (and protrusion 662) of the frame 640 while also biasing the handle portion 558 in a direction generally downwardly and toward the web engaging surface 657 of frame 640. With this configuration, upward pressure on the handle portion 558; i.e., pressure on the handle portion in a direction generally away from the web engaging surface 657 of frame 640, is required to force the web engaging surface 666 of the web clamping member 658 away from the web engaging surface 657 (and protrusion 662) of frame 640. Alternatively, the biasing member 680 may be positioned relative to the device 635 so as to bias the web engaging surface 666 of the web clamping member 658 toward the web engaging surface 657 (and protrusion 662) of the frame 640 while also biasing the handle portion 658 in a direction generally upwardly and away from the web engaging surface 657 of frame 640. With this configuration, downward pressure on the handle portion 658; i.e., pressure on the handle portion in a direction generally toward the web engaging surface 657 of frame 640, is required to force the web engaging surface 666 of the web clamping member 658 away from the web engaging surface 657 (and protrusion 662) of frame 640.

Unlike device 335, the frame 640 of device 635 does not include a back portion; i.e., a raised portion adjacent to handle portion 658. The position and configuration of the web engaging surface 662 of the web clamping member 654 relative to the position and configuration of the protrusion 662 defining the web engaging surface of the frame 640 is designed to suitably trap and lock the web therebetween in the direction 372, and to allow travel of the web in the opposite direction, thereby obviating any need for a back portion of frame 640.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. A web adjuster device comprising:

a frame having a bottom surface and an opposite top surface defining a first web engaging surface, the frame including a pair of upstanding side walls extending upwardly away from the first web engaging surface;

a web clamping member movably mounted to the frame between the pair of side walls, the web clamping member defining a second web engaging surface and a third web engaging surface separate from the second web engaging surface; and a web extending into a first end of the frame through an opposite second end of the frame, the web received between the sidewalls and between the first and second web engaging surfaces and in contact with the third web engaging surface;

wherein the web traveling in a first direction through the device engages the third web engaging surface to force the second web engaging surface toward the first web engaging surface to trap the web therebetween, and the web traveling in a second opposite direction through the device engages the third web engaging surface to force the second web engaging surface away from the first web engaging surface to allow web travel in the second opposite direction, the third web engaging surface being maintained within the frame above the bottom surface of the frame through full range of movement of the web clamping member relative to the frame;

wherein the first and second web engaging surfaces are configured to grip the web as the second web engaging surface of the web clamping member is forced toward the first web engaging surface of the frame;

wherein the web clamping member includes a handle portion configured for manual manipulation of the web clamping member; and wherein the web clamping member includes a protrusion extending downwardly toward the top surface of the frame, the protrusion defining the third web engaging surface of the web clamping member; and wherein the protrusion is located between the second web engaging surface of the web clamping member and the handle portion thereof.

2. The web adjuster device of claim 1 wherein each of the sidewalls of the frame define a channel therethrough; and wherein the protrusion of the web clamping member defines a pin on opposite sides thereof, the pins received within the channels of the sidewalls to thereby limit movement of the web clamping member relative to the frame.

3. A web adjuster device comprising:

a frame having a bottom surface and an opposite top surface defining a first web engaging surface, the frame including a pair of upstanding side walls extending upwardly away from the first web engaging surface;

a web clamping member movably mounted to the frame between the pair of side walls, the web clamping member defining a second web engaging surface and a third web engaging surface separate from the second web engaging surface; and a web extending into a first end of the frame through an opposite second end of the frame, the web received between the sidewalls and between the first and second web engaging surfaces and in contact with the third web engaging surface;

wherein the web traveling in a first direction through the device engages the third web engaging surface to force the second web engaging surface toward the first web engaging surface to trap the web therebetween, and the web traveling in a second opposite direction through the device engages the third web engaging surface to force the second web engaging surface away from the first web engaging surface to allow web travel in the second opposite direction, the third web engaging surface being maintained within the frame above the bottom surface of the frame through full range of movement of the web clamping member relative to the frame; and wherein the web clamping member includes a protrusion extending downwardly toward the top surface of the frame, the protrusion defining the third web engaging surface of the web clamping member.

4. The web adjuster device of claim 3 wherein the web clamping member includes a handle portion configured for manual manipulation of the web clamping member; and wherein the protrusion of the web clamping member is located between the second web engaging surface and handle portion thereof.

5. A web adjuster device comprising:

a frame having a bottom surface and an opposite top surface defining a first web engaging surface, the frame including a pair of upstanding side walls extending upwardly away from the first web engaging surface; and a web clamping member movably mounted to the frame between the pair of side walls, the web clamping member defining a second web engaging surface and a third web engaging surface separate from the second web engaging surface;

wherein the frame is configured to receive therein from a first end through a second opposite end a web extending between the sidewalls and between the first and second web engaging surfaces and in contact with the third web engaging surface;

wherein the third web engaging surface is configured to be responsive to a first direction of web travel through the device to force the second web engaging surface toward the first web engaging surface, and to a second opposite direction of web travel through the device to force the second web engaging surface away from the first web engaging surface, the third web engaging surface being maintained within the frame above the bottom surface of the frame through full range of movement of the web clamping member relative to the frame; and wherein the web clamping member includes a protrusion extending downwardly toward the top surface of the frame, the protrusion defining the third web engaging surface of the web clamping member.

6. The web adjuster device of claim 5 wherein the web clamping member includes a handle portion configured for manual manipulation of the web clamping member; and wherein the protrusion of the web clamping member is located between the second web engaging surface and handle portion thereof.

7. A web adjuster device comprising:

a frame having a bottom surface and an opposite top surface defining a first web engaging surface, the frame including a pair of upstanding side walls extending upwardly away from the first web engaging surface; and a web clamping member movably mounted to the frame between the pair of side walls, the web clamping member defining a second web engaging surface and a third web engaging surface separate from the second web engaging surface;

wherein the frame is configured to receive therein from a first end through a second opposite end a web extending between the sidewalls and between the first and second web engaging surfaces and in contact with the third web engaging surface;

wherein the third web engaging surface is configured to be responsive to a first direction of web travel through the device to force the second web engaging surface toward the first web engaging surface, and to a second opposite direction of web travel through the device to force the second web engaging surface away from the first web engaging surface, the third web engaging surface being maintained within the frame above the bottom surface of the frame through full range of movement of the web clamping member relative to the frame;

wherein the first web engaging surface of the frame defines a plane; and wherein the second opposite end of the frame defines a back wall extending upwardly away from the first web engaging surface and terminating at a top web-engaging edge positioned above the plane defined by the first web engaging surface;

wherein the first and second web engaging surfaces are configured to grip a web extending therebetween as the second web engaging surface of the web clamping member is forced toward the first web engaging surface of the frame;

wherein the web clamping member includes a handle portion configured for manual manipulation of the web clamping member; and wherein the web clamping member includes a protrusion extending downwardly toward the top surface of the frame, the protrusion defining the third web engaging surface of the web clamping member; and wherein the protrusion is located between the second web engaging surface of the web clamping member and the handle portion thereof.

8. The web adjuster device of claim 7 wherein each of the sidewalls of the frame define a channel therethrough; and wherein the protrusion of the web clamping member defines a pin on opposite sides thereof, the pins received within the channels of the sidewalls to thereby limit movement of the web clamping member relative to the frame.

9. A web adjuster device comprising:

a frame having a bottom surface and an opposite top surface defining a first web engaging surface, the frame including a pair of upstanding side walls extending upwardly away from the first web engaging surface; and a web clamping member movably mounted to the frame between the pair of side walls, the web clamping member defining a second web engaging surface and a third web engaging surface separate from the second web engaging surface;

wherein the frame is configured to receive therein from a first end through a second opposite end a web extending between the sidewalls and between the first and second web engaging surfaces and in contact with the third web engaging surface;

wherein the third web engaging surface is configured to be responsive to a first direction of web travel through the device to force the second web engaging surface toward the first web engaging surface, and to a second opposite direction of web travel through the device to force the second web engaging surface away from the first web engaging surface, the third web engaging surface being maintained within the frame above the bottom surface of the frame through full range of movement of the web clamping member relative to the frame; and further including a mounting plate defining a top surface and a pair of upstanding sidewalls extending upwardly away from the top surface of the mounting plate, the mounting plate mounted to the frame with the top surface of the mounting plate in contact with the bottom surface of the frame and with the web clamping member movably mounted between the upstanding sidewalls of the mounting plate.

10. The web adjuster device of claim 9 wherein the web clamping member is pivotally mounted to the frame between the upstanding sidewalls.

11. A web adjuster device comprising:

a frame having a bottom surface and an opposite top surface defining a first web engaging surface, the frame including a pair of upstanding side walls extending upwardly away from the first web engaging surface;

a web clamping member movably mounted to the frame between the pair of side walls, the web clamping member defining a second web engaging surface and a third web engaging surface separate from the second web engaging surface; and a web extending into a first end of the frame through an opposite second end of the frame, the web received between the sidewalls and between the first and second web engaging surfaces and in contact with the third web engaging surface;

wherein the web traveling in a first direction through the device engages the third web engaging surface to force the second web engaging surface toward the first web engaging surface to trap the web therebetween, and the web traveling in a second opposite direction through the device engages the third web engaging surface to force the second web engaging surface away from the first web engaging surface to allow web travel in the second opposite direction, the third web engaging surface being maintained within the frame above the bottom surface of the frame through full range of movement of the web clamping member relative to the frame; and further including a mounting plate defining a top surface and a pair of upstanding sidewalls extending upwardly away from the top surface of the mounting plate, the mounting plate mounted to the frame with the top surface of the mounting plate in contact with the bottom surface of the frame and with the web clamping member movably mounted between the upstanding sidewalls of the mounting plate.

12. A web adjuster device comprising:

a frame having a bottom surface and an opposite top surface defining a first web engaging surface, the frame including a pair of upstanding side walls extending upwardly away from the first web engaging surface;

a web path extending between the sidewalls into a first end of the frame past the first web engaging surface through an opposite second end of the frame;

a web clamping member movably mounted to the frame between the pair of side walls, the web clamping member defining adjacent first and second cam surfaces and only one web engaging surface located along the web path away from the adjacent first and second cam surfaces;

wherein the first cam surface is positioned to react to unlock the web clamping member from a web during forcing of the web in the unlocking direction, the second cam surface is positioned to react to lock the web between the first web engaging surface and the only one web engaging surface during forcing of the web in the locking direction; and wherein the first web engaging surface of the frame defines a plane; and wherein the second opposite end of the frame defines a back wall extending upwardly away from the first web engaging surface and terminating at a top web-engaging edge positioned above the plane defined by the first web engaging surface.

13. The web adjuster device of claim 12 wherein the first and second web engaging surfaces are configured to grip a web extending therebetween as the second web engaging surface of the web clamping member is forced toward the first web engaging surface of the frame.

14. The web adjuster device of claim 13 wherein the web clamping member includes a handle portion configured for manual manipulation of the web clamping member.

15. The web adjuster device of claim 14 further including a biasing mechanism mounted in contact with the web clamping member and the frame, the biasing mechanism biasing the second web engaging surface of the web clamping member toward the first web engaging surface of the frame.

16. The web adjuster device of claim 15 wherein the web clamping member includes a protrusion extending toward the back wall of the frame, the protrusion defining the third web engaging surface of the web clamping member.

17. A web adjuster device comprising:

a frame having a bottom surface and an opposite top surface defining a first web engaging surface, the frame including a pair of upstanding side walls extending upwardly away from the first web engaging surface;

a web path extending between the sidewalls into a first end of the frame past the first web engaging surface through an opposite second end of the frame;

a pivot axis and a web clamping member pivotally mounted about the axis to the frame between the pair of side walls, the web clamping member defining only one web engaging surface and first and second cam surfaces, the first and second cam surfaces being located in a direction perpendicular to the axis on a first side of the axis of the clamping member and the only one web engaging surface being located on a second opposite side of the axis of the clamping member;

wherein the first cam surface is positioned to react to unlock the web clamping member from a web during forcing of the web in the unlocking direction, the second cam surface is positioned to react to lock the web between the first web engaging surface and the second web engaging surface during forcing of the web in the locking direction; and wherein the first web engaging surface of the frame defines a plane; and wherein the second opposite end of the frame defines a back wall extending upwardly away from the first web engaging surface and terminating at a top web-engaging edge positioned above the plane defined by the first web engaging surface.

* * * * *

UNITED STATES PATENT AND TRADEMARK OFFICE

CERTIFICATE OF CORRECTION

PATENT NO. : 6,868,585 B2
DATED : March 22, 2005
INVENTOR(S) : Anthony et al.

It is certified that error appears in the above-identified patent and that said Letters Patent is hereby corrected as shown below:

Title page,
Item [75], Inventors, change "Steven T. Berenyl" to -- Steven T. Berenyl --.

Signed and Sealed this

Seventh Day of February, 2006

JON W. DUDAS
*Director of the United States Patent and Trademark Office*

UNITED STATES PATENT AND TRADEMARK OFFICE

CERTIFICATE OF CORRECTION

PATENT NO. : 6,868,585 B2
DATED : March 22, 2005
INVENTOR(S) : Anthony et al.

It is certified that error appears in the above-identified patent and that said Letters Patent is hereby corrected as shown below:

Title page,
Item [75], Inventors, change "Steven T. Berenyl" to -- Steven T. Berenyi --.

This certificate supersedes Certificate of Correction issued February 7, 2006.

Signed and Sealed this

Twenty-fifth Day of April, 2006

JON W. DUDAS
*Director of the United States Patent and Trademark Office*